United States Patent [19]

Kawaguchi et al.

[11] Patent Number: 4,651,117

[45] Date of Patent: Mar. 17, 1987

[54] SUPERCONDUCTING MAGNET WITH SHIELDING APPARATUS

[75] Inventors: Takeo Kawaguchi, Akashi; Takashi Sato, Kawanishi, both of Japan

[73] Assignee: Mitsubishi Denki Kabushiki Kaisha, Tokyo, Japan

[21] Appl. No.: 792,930

[22] Filed: Oct. 30, 1985

[30] Foreign Application Priority Data

Nov. 7, 1984 [JP] Japan ..... 59-236433

[51] Int. Cl.[4] ..... H01F 7/22

[52] U.S. Cl. ..... 335/216; 335/301

[58] Field of Search ..... 335/216, 214, 301; 336/DIG. 1; 174/126 S, 128 S

[56] References Cited

U.S. PATENT DOCUMENTS 3,428,925 2/1969 Bogner et al. ..... 335/216

3,671,902 6/1972 Westendorp ..... 335/214 X

OTHER PUBLICATIONS

"A Thin Superconducting Magnet Solenoid Wound with the Integral Winding Method for Colliding Beam Experiments", Yamamoto et al., 8th International Conference on Magnet Technology, published in Journal de Physique, Jan. 1984 Supplement, pp. CL337 to CL-340.

*Primary Examiner*—George Harris

*Attorney, Agent, or Firm*—Leydig, Voit & Mayer

[57] ABSTRACT

A superconducting magnet auxiliary heat shield for providing additional shielding of a superconducting coil against heat radiation. The auxiliary heat shield is disposed between a superconducting coil bonded to a cylindrical coil care and a main heat shield on the radially inner side of the superconducting coil.

2 Claims, 2 Drawing Figures

SUPERCONDUCTING MAGNET WITH SHIELDING APPARATUS

BACKGROUND OF THE INVENTION

This invention relates to a superconducting magnet having a superconducting coil wound on the inner circumference of a coil case, and more particularly to a superconducting magnet having an auxiliary shield for shielding the superconducting coil against radiant heat from the exterior.

A conventional superconducting magnet of this type is described in an article entitled "A Thin Superconducting Magnet Solenoid wound with the Internal Winding Method for Colliding Beam Experiments", published in "Journal de Physique", January, 1984 Supplement, PP. Cl-337 to Cl-340, the contents of the article being originally presented at the 8th International Conference on Magnet Technology held at Grenoble, France, September 5th–9th, 1983.

A partial drawing of the conventional magnet apparatus is illustrated in FIG. 1. Referring to the drawing, a coil case 1 which is made of aluminium is cooled by a cryogenic refrigerant such as liquid helium flowing through holes formed therein or through tubing provided therearound. On the inner circumference of the coil case 1, there is provided a cylindrical superconducting coil which is wound by the coil lead 2*a*. An electrically insulating layer 3 is disposed between the inner surface of the coil case 1 and the outer circumference of the superconducting coil 2. This layer is made of epoxy resin or glass wool and is bonded to both the coil case 1 and the coil 2 so as to achieve good heat conductivity therebetween.

A main heat shield 4 surrounds the coil case 1 and the superconducting coil 2 with a vacuum 5 maintained therebetween. The main heat shield 4 is cooled by liquid nitrogen flowing through tubing 11 disposed on the surface thereof.

The above members are disposed inside a vacuum container 6 in which a vacuum 5 is maintained. The main heat shield 4 is supported by tensile support members 10 which are secured to the inner walls 6*a* of the vacuum container and which have a high thermal resistance. The coil case 1 is similarly supported inside the main heat shield 4.

The operation of the illustrated magnet is as follows. The coil case 1 is cooled by the liquid helium and then cools the superconducting coil 2 wound on the inner circumference thereof to about 5K (Kelvin's temperature) and maintains the cryogenic state. A vacuum 5 is maintained between the superconducting coil 2 and the main heat shield 4, and between the main heat shielding 4 and the vacuum vessel 6 so as to provide heat insulation. When a current flows through the superconducting coil 2, a magnetic field is generated. This magnetic field provides a radially outward force on the superconducting coil 2. To support this electromagnetic force, the coil case 1 is disposed on the outer circumference of the superconducting coil 2. As there is no mechanical supporting member on the inner surface of the superconducting coil 2, the weight of the magnet can be decreased and the permeability of particles can be increased in an experiment of high-energy physics.

The conventional apparatus having the above-described structure has the disadvantage that when the superconducting coil 2 becomes unbonded from the coil case 1 due to repeated stresses experienced over a long period of use, a large thermal resistance develops between the coil case 1 and the superconducting coil 2 and the superconducting coil 2 is irradiated by radiant heat from the main heat shield 4. The temperature of the coil 2 therefore rises, and a predetermined performance can not be obtained.

SUMMARY OF THE INVENTION

It is an object of the present invention to eliminate the disadvantages of the above conventional magnet.

Another object of this invention is to provide a superconducting magnet with high reliability and an auxiliary heat shield which prevents a superconducting coil from decreasing in the performance.

With the above objects in view, the superconducting magnet of this invention comprises a superconducting coil, cooling means disposed on an outer circumference of the coil for cooling the coil to a cryogenic temperature, bonding means for bonding the coil and the cooling means to establish a high thermal conductivity therebetween, a main shield for surrounding the cooling means and the coil for shielding them against radiant heat from the exterior, an auxiliary shield disposed between the coil and the main shield opposite to the cooling means with regard to the coil for additionally shielding the coil against radiant heat, and a vacuum vessel enclosing the main shield.

DESCRIPTION OF THE PREFERRED EMBODIMENT

Figure 1:
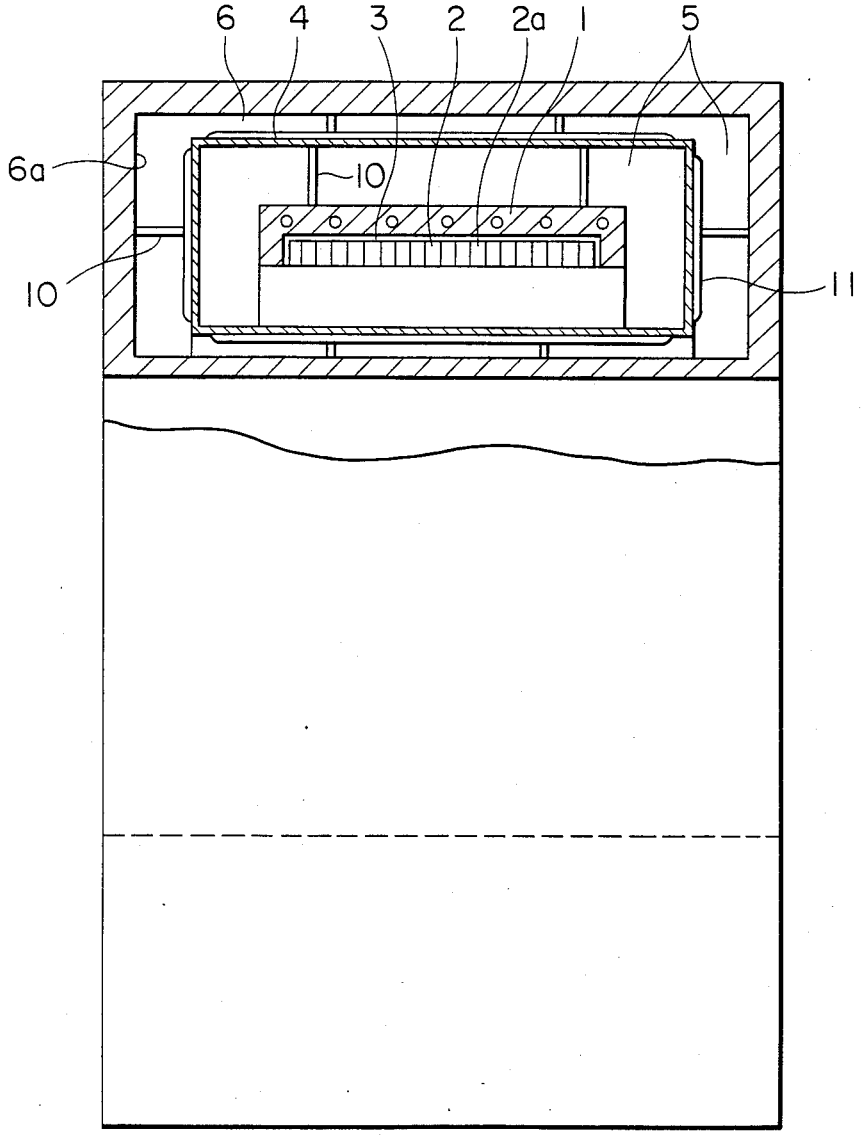
FIG. 1 PRIOR ART
FIG. 1 is a partially cross-sectional view of a conventional superconducting magnet.

An embodiment of the present invention will now be described while referring to FIG. 2 of the accompanying drawings, in which the same reference numerals as in FIG. 1 indicate the same or corresponding portions.

Figure 2:
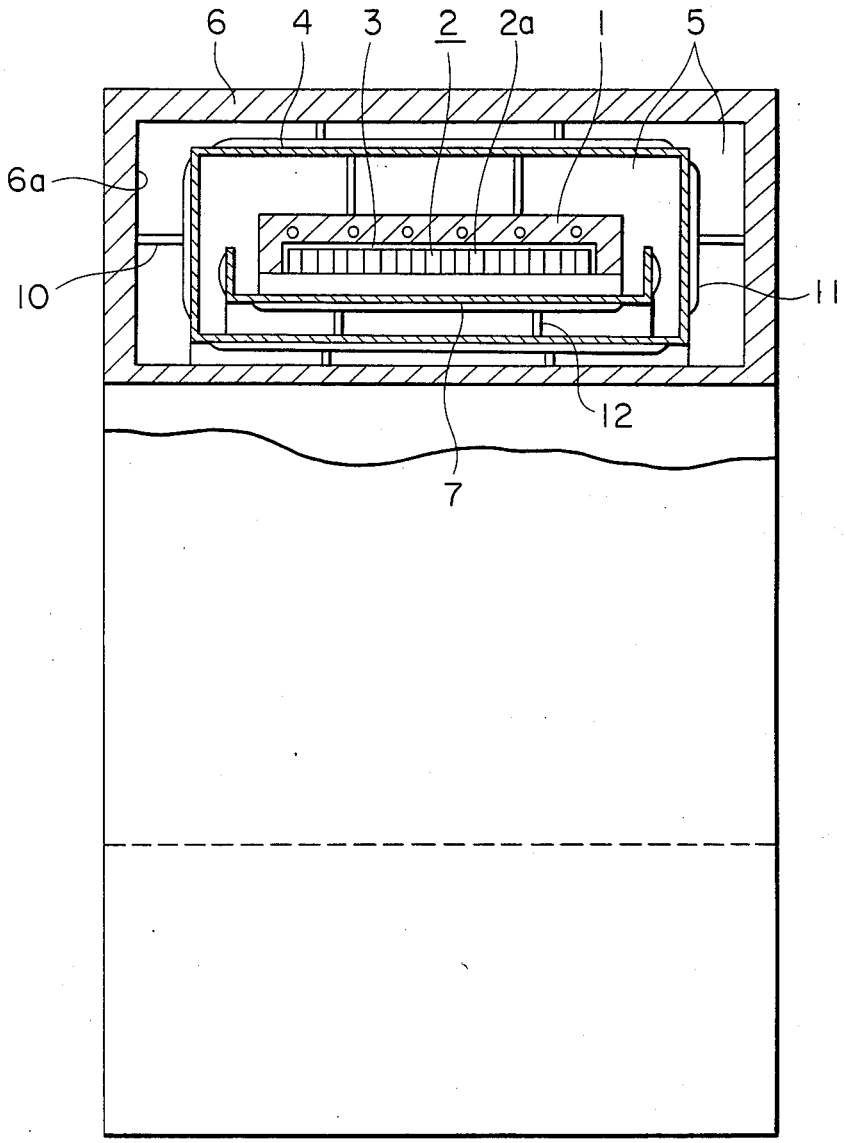
FIG. 2 is a partially cross-sectional view of one embodiment of this invention.

The present embodiment of FIG. 2 differs from the magnet of FIG. 1 in that an auxiliary heat shield 7 is disposed between the inner circumference of the superconducting coil 2 and the main heat shield 4. The auxiliary heat shield 7 that has a U-shaped cross section radially outwardly open is made of a material such as aluminium or copper, and is cooled by liquid helium flowing through tubing 11 provided on the surface thereof to a cryogenic temperature of, for example, less than 10K Kelvin temperature). This tubing is communicated with a passage for a refrigerant of the coil case 1. The auxiliary heat shield 7 is secured to the main heat shield 4 by heat insulating support members 10. The apparatus of this invention is below compared with a conventional one on the basis of radiant heat amount. The temperature of the superconducting coil 2, the main heat shield 4, and the auxiliary heat shield 7 will be presumed to be 5K, 80K, and 10K, respectively. The ratio of radiant heat amount is as follows.

$$\frac{\text{radiant heat amount of the present invention's apparatus}}{\text{radiant heat amount of the conventional apparatus}} = \frac{\text{10 to the fourth power} - \text{5 to the fourth power}}{\text{80 to the fourth power} - \text{5 to the fourth power}} = \frac{1}{4730}$$

Thus, the present invention greatly decreases the amount of radiant heat reaching the superconducting coil. Even when the heat resistance between the coil case 1 and the superconducting coil 2 increases due to many years of use, the present invention can limit the temperature increase of the superconducting coil 2 to a low level, and maintain the performance of the magnet.

What is claimed is:

1. A superconducting magnet comprising;

a superconducting coil, cooling means disposed on an outer circumference of said coil for cooling said coil to a cryogenic temperature;

bonding means for bonding said coil and said cooling means to establish a high thermal conductivity therebetween;

main shield surrounding said cooling means and said coil for shielding them against radiant heat from the exterior;

auxiliary shield disposed between said coil means and said main shield opposite to said cooling means with regard to said coil for additionally shielding said coil against radiant heat; and a vacuum vessel enclosing said main shield.

2. A superconducting magnet apparatus as claimed in claim 1, characterized in that said auxiliary shield has a U-shaped cross section radially outwardly open.

* * * * *